US010336070B2

(12) United States Patent
McGuinness et al.

(10) Patent No.: US 10,336,070 B2
(45) Date of Patent: Jul. 2, 2019

(54) FLUID EJECTION DEVICE WITH A FLUID RECIRCULATION CHANNEL

(71) Applicant: HEWLETT-PACKARD DEVELOPMENT COMPANY, L.P., Houston, TX (US)

(72) Inventors: Nicholas Matthew Cooper McGuinness, San Diego, CA (US); Alexander Govyadinov, Corvallis, OR (US); Chris Bakker, Aguadilla, PR (US); Lawrence H. White, Corvallis, OR (US); Paul A. Richards, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/747,966

(22) PCT Filed: Oct. 30, 2015

(86) PCT No.: PCT/US2015/058361

§ 371 (c)(1),
(2) Date: Jan. 26, 2018

(87) PCT Pub. No.: WO2017/074427

PCT Pub. Date: May 4, 2017

(65) Prior Publication Data

US 2018/0215146 A1 Aug. 2, 2018

(51) Int. Cl.
*B41J 2/14* (2006.01)

(52) U.S. Cl.
CPC ..... *B41J 2/1404* (2013.01); *B41J 2/14056* (2013.01); *B41J 2202/11* (2013.01); *B41J 2202/12* (2013.01)

(58) Field of Classification Search
CPC ..... B41J 2/1404; B41J 2/14056
See application file for complete search history.

(56) References Cited

U.S. PATENT DOCUMENTS 5,463,413 A * 10/1995 Ho ..... B41J 2/1404 347/65
5,818,485 A 10/1998 Rezanka
(Continued)

FOREIGN PATENT DOCUMENTS

JP 2007098807 4/2007

OTHER PUBLICATIONS

CPA Patentability Search Report http://www.ingentaconnect.com/content/ist/nipdf/2008/00002008/00000002/art00102 Zapka, W. et al. Improved Reliability in Industrial Inkjet.
(Continued)

*Primary Examiner* — Juanita D Jackson
(74) *Attorney, Agent, or Firm* — HP Inc. Patent Department

(57) ABSTRACT

According to an example, a fluid ejection device may include a fluid feed slot, a plurality of fluid ejection chambers in fluid communication with the fluid feed slot, a plurality of drop ejecting elements, in which a drop ejecting element of the plurality of drop ejecting elements is positioned within each of the plurality of fluid ejection chambers, a fluid circulation channel in fluid communication at a first end of the fluid circulation channel with the fluid feed slot and in fluid communication at multiple second ends of the fluid circulation channel with the plurality of fluid ejection chambers, and a fluid circulating element within the fluid circulation channel. The fluid ejection device may also include a bubble dissipating structure positioned within the fluid circulation channel outside of the plurality of fluid ejection chambers.

20 Claims, 5 Drawing Sheets

(56) References Cited

U.S. PATENT DOCUMENTS

| | | | | |
|---|---|---|---|---|
| 7,971,981 | B2 | 7/2011 | Nagashima et al. | |
| 8,336,996 | B2 | 12/2012 | Silverbrook | |
| 8,356,867 | B2 | 1/2013 | Lee et al. | |
| 8,721,060 | B2 | 5/2014 | Yokoyama et al. | |
| 2008/0198208 | A1 | 8/2008 | Kyoso et al. | |
| 2013/0155135 | A1* | 6/2013 | Govyadinov | B41J 2/14129 347/10 |
| 2015/0070446 | A1 | 3/2015 | Taff et al. | |
| 2015/0273853 | A1 | 10/2015 | Govyadinov et al. | |

OTHER PUBLICATIONS

International Searching Authority., International Search Report and Written Opinion dated Aug. 25, 2016 for PCT Application No. PCT/US2015/058361 Filed Oct. 30, 2015, 13 pgs.

* cited by examiner

FLUID EJECTION DEVICE WITH A FLUID RECIRCULATION CHANNEL

BACKGROUND

Fluid ejection devices, such as printheads in inkjet printing systems, typically use thermal resistors or piezoelectric material membranes as actuators within fluidic chambers to eject fluid drops (e.g., ink) from nozzles, such that, properly sequenced ejection of ink drops from the nozzles causes characters or other images to be printed on a print medium as the printhead and the print medium move relative to each other. The formation of air bubbles or other particles can negatively impact operation of a fluid ejection device. For example, air bubbles or other particles in an ejection chamber of a printhead may disrupt the ejection of drops from the ejection chamber, thereby resulting in misdirection of drops from the printhead or missing drops. Such disruption of drops often results in print defects and degrades print quality.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
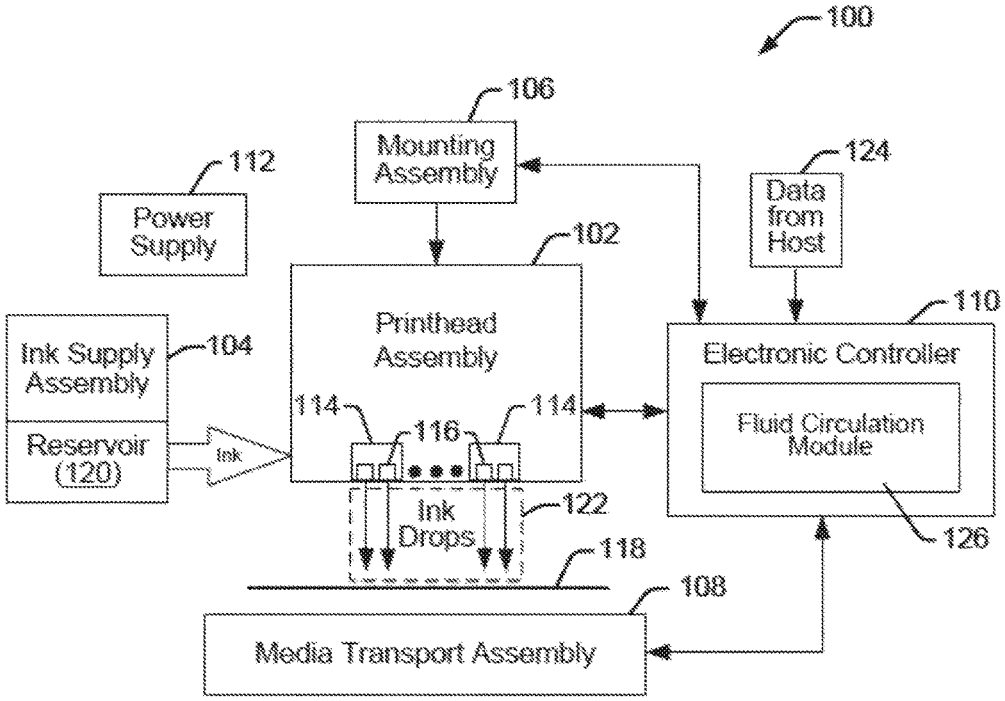
FIG. 1 depicts a simplified block diagram of an inkjet printing system, according to an example of the present disclosure.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Additionally, it should be understood that the elements depicted in the accompanying figures may include additional components and that some of the components described in those figures may be removed and/or modified without departing from scopes of the elements disclosed herein. It should also be understood that the elements depicted in the figures may not be drawn to scale and thus, the elements may have different sizes and/or configurations other than as shown in the figures.

Disclosed herein are fluid ejection devices and methods for forming the fluid ejection devices. The fluid ejection devices disclosed herein may include a plurality of fluid ejection chambers and a fluid circulation channel that are in fluid communication with a fluid feed slot. Fluid from the fluid feed slot may flow (e.g., circulate or recirculate) through the fluid ejection chambers and the fluid circulation channel through actuation of drop ejecting elements in the fluid ejection chambers or a fluid circulating element in the fluid circulation channel. The fluid ejection chambers may each include a nozzle or opening through which fluid is to be expelled from the fluid ejection devices when a respective drop ejecting element is actuated. The fluid ejection devices may also include a bubble dissipating structure (or a plurality of bubble dissipating structures) positioned within the fluid circulation channel outside of the plurality of fluid ejection chambers. The bubble dissipating structure may form an "island" in the fluid circulation channel that allows fluid to flow around the bubble dissipating structure while preventing particles such as air bubbles from flowing into the fluid ejection chambers or a section of the fluid circulation channel containing the fluid circulating element. That is, for instance, the bubble dissipating structure may dissipate bubbles when the bubbles contact the bubble dissipating structure, for instance, by breaking up the bubbles such that they become of sufficiently small size to collapse.

Through implementation of the fluid ejection devices and methods disclosed herein, ink blockage and/or clogging in fluid ejection devices may be reduced. In addition, the use of the bubble dissipating structure inside the fluid ejection devices may help to prevent air bubbles and/or other particles from entering the fluid ejection chambers, which may also reduce disruption of the ejection of drops of fluid from the fluid ejection chambers.

With reference first to FIG. 1, there is shown a simplified block diagram of an inkjet printing system 100, according to an example. The inkjet printing system 100 may also be referenced herein as a fluid ejection device, in which fluid may be recirculated. The inkjet printing system 100 is depicted as including a printhead assembly 102, an ink supply assembly 104, a mounting assembly 106, a media transport assembly 108, an electronic controller 110, and at least one power supply 112 that provides power to the various electrical components of the inkjet printing system 100. The printhead assembly 102 is also depicted as including a fluid ejection assembly 114 (or, equivalently, printheads 114) that ejects drops of ink through a plurality of orifices or nozzles 116 toward a print media 118 so as to print on the print media 118.

The print media 118 may be any type of suitable sheet or roll material, such as paper, card stock, transparencies, Mylar, and the like. The nozzles 116 may be arranged in one or more columns or arrays such that properly sequenced ejection of ink from the nozzles 116 causes characters, symbols, and/or other graphics or images to be printed on print media 118 as the printhead assembly 102 and print media 118 are moved relative to each other.

The ink supply assembly 104 may supply fluid ink to the printhead assembly 102 and, in one example, includes a reservoir 120 for storing ink such that ink flows from the reservoir 120 to the printhead assembly 102. The ink supply assembly 104 and the printhead assembly 102 may form a one-way ink delivery system of a recirculating ink delivery system. In a one-way ink delivery system, substantially all of the ink supplied to the printhead assembly 102 is consumed during printing. In a recirculating ink delivery system, only a portion of the ink supplied to printhead assembly 102 is consumed during printing and ink that is not consumed during printing may be returned to the ink supply assembly 104.

In one example, the printhead assembly 102 and the ink supply assembly 104 are housed together in an inkjet cartridge or pen. In another example, the ink supply assembly 104 is separate from printhead assembly 102 and supplies ink to the printhead assembly 102 through an interface connection, such as a supply tube. In either example, the reservoir 120 of ink supply assembly 104 may be removed, replaced, and/or refilled. Where the printhead assembly 102 and the ink supply assembly 104 are housed together in an inkjet cartridge, the reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

The mounting assembly 106 is to position the printhead assembly 102 relative to the media transport assembly 108, and the media transport assembly 108 is to position the print media 118 relative to the printhead assembly 102. Thus, a print zone 122 may be defined adjacent to the nozzles 116 in an area between the printhead assembly 102 and the print media 118. In one example, the printhead assembly 102 is a scanning type printhead assembly. In this example, the mounting assembly 106 includes a carriage for moving the printhead assembly 102 relative to the media transport assembly 108 to scan across the print media 118. In another example, the printhead assembly 102 is a non-scanning type printhead assembly. In this example, the mounting assembly 106 fixes the printhead assembly 102 at a prescribed position relative to the media transport assembly 108. Thus, the media transport assembly 108 may position the print media relative to the printhead assembly 102.

The electronic controller 110 may include a processor, firmware, software, one or more memory components including volatile and non-volatile memory components, and other printer electronics for communicating with and controlling the printhead assembly 102, the mounting assembly 106, and the media transport assembly 108. The electronic controller 110 may receive data 124 from a host system, such as a computer, and may temporarily store the data 124 in a memory (not shown). The data 124 may be sent to the inkjet printing system 100 along an electronic, infrared, optical, or other information transfer path. The data 124 may represent, for example, a document and/or file to be printed. As such, the data 124 may form a print job for the inkjet printing system 100 and may include one or more print job commands and/or command parameters.

In one example, the electronic controller 110 controls the printhead assembly 162 for ejection of ink drops from the nozzles 116. Thus, the electronic controller 110 may define a pattern of ejected ink drops which form characters, symbols, and/or other graphics or images on the print media 118. The pattern ejected ink drops may be determined by the print job commands and/or command parameters.

The printhead assembly 102 may include a plurality of printheads 114. In one example, the printhead assembly 102 is a wide-array or multi-head printhead assembly. In one implementation of a wide-array assembly, the printhead assembly 102 includes a carrier that carries the plurality of printheads 114, provides electrical communication between the printheads 114 and the electronic controller 110, and provides fluidic communication between the printheads 114 and the ink supply assembly 104.

In one example, the inkjet printing system 100 is drop-on-demand thermal inkjet printing system in which the printhead 114 is a thermal inkjet (TIJ) printhead. The thermal inkjet printhead may implement a thermal resistor ejection element in an ink chamber to vaporize ink and create bubbles that force ink or other fluid drops out of the nozzles 116. In another example, the inkjet printing system 100 is a drop-on-demand piezoelectric inkjet printing system in which the printhead 114 is a piezoelectric inkjet (PIJ) printhead that implements a piezoelectric material actuator as an ejection element to generate pressure pulses that force ink drops out of the nozzles 116.

According to an example, the electronic controller 110 includes a flow circulation module 126 stored in a memory of the electronic controller 110. The flow circulation module 126 may execute on the electronic controller 110 (i.e., a processor of the electronic controller 110) to control the operation of one or more fluid actuators integrated as pump elements within the printhead assembly 102 to control circulation of fluid within the printhead assembly 102, as described in greater detail herein below.

Figure 2B:
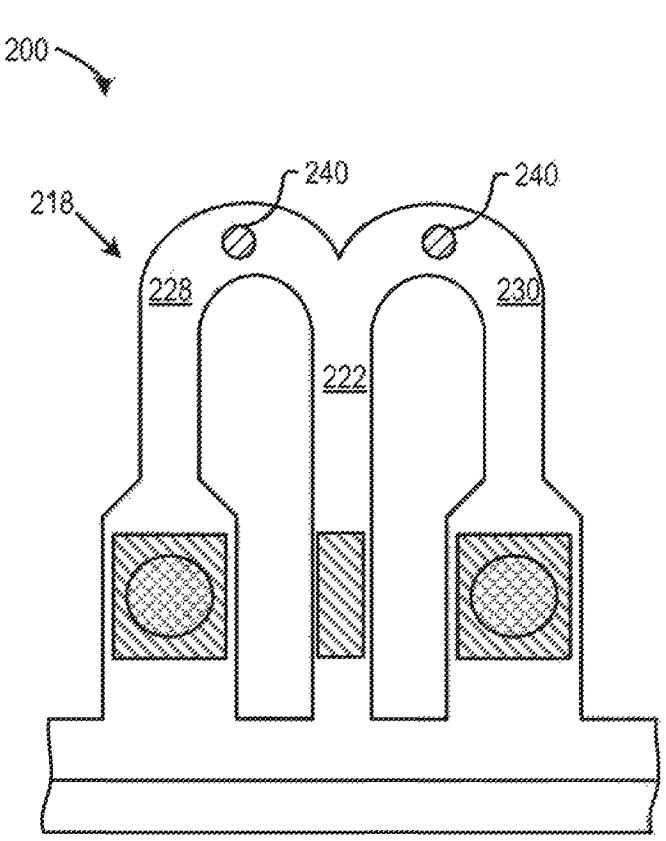
FIGS. 2A-2E, respectively, show schematic plan views of a portion of a fluid election device, according to examples of the present disclosure.
Figure 2A:
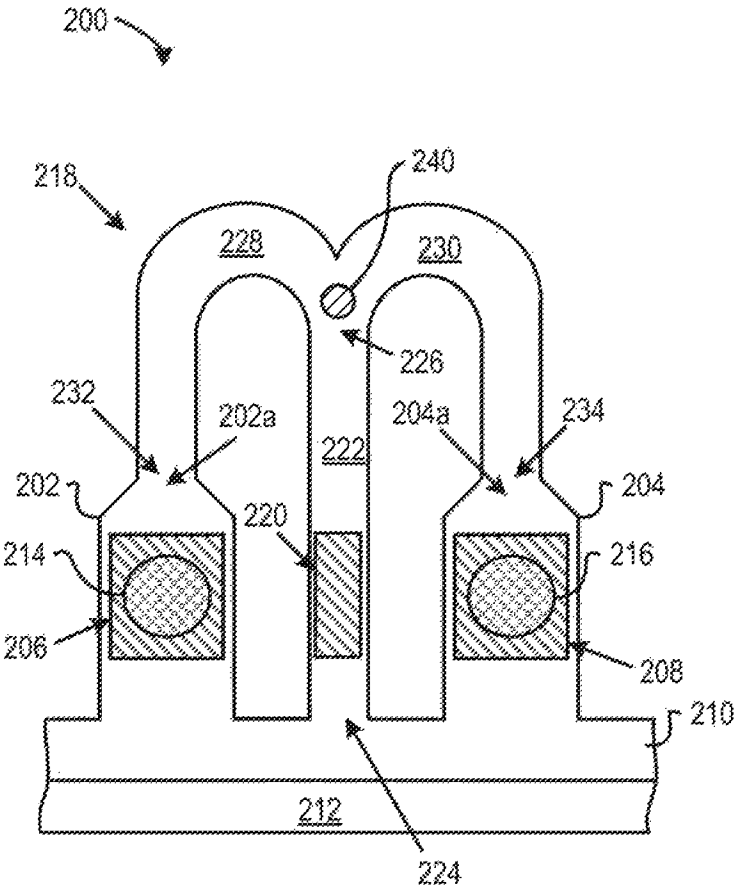

With reference now to FIG. 2A, there is shown a schematic plan view of a portion of a fluid ejection device 200, according to an example. As shown in FIG. 2A, the fluid ejection device 200 may include a plurality of fluid ejection chambers 202, 204 and a corresponding drop ejecting element 206, 208 formed in, provided within, or communicated with a respective fluid ejection chamber 202, 204. The fluid ejection chambers 202, 204 and the drop ejecting elements 206, 208 may be formed on a substrate 210, which has a fluid (or ink) feed slot 212 formed therein such that the fluid feed slot 212 provides a supply of fluid (or ink) to the fluid ejection chambers 202, 204 and the drop ejecting elements 206, 208. The substrate 210 may be formed, for example, of silicon, glass, or a stable polymer. According to an example, a plurality of portions similar to the portion depicted in FIG. 2A may be provided along the substrate 210.

In one example, the fluid ejection chambers 202, 204 are formed in or defined by a barrier layer (not shown) provided on the substrate 210, such that the fluid ejection chambers 202, 204 provide a "wells" in the barrier layer. The barrier layer may be formed, for example, of a photoimageable epoxy resin, such as SU8.

According to an example, a nozzle or orifice layer (not shown) is formed or extended over the barrier layer such that a nozzle opening or orifice 214, 216 formed in the orifice layer communicates with a respective fluid ejection chamber 202, 204. The nozzle openings or orifices 214, 216 may be of a circular, non-circular, or other shape.

Each of the drop ejecting elements 206, 208 may be any device that is to eject fluid drops through corresponding nozzle openings or orifices 214, 216. Examples of suitable drop ejecting elements 206, 208 include thermal resistors and piezoelectric actuators. A thermal resistor, as an example of a drop ejecting element, may be formed on a surface of a substrate (substrate 210), and may include a thin-film stack including an oxide layer, a metal layer, and a passivation layer such that, when activated, heat from the thermal resistor vaporizes fluid in a fluid ejection chamber 202, thereby causing a bubble that ejects a drop of fluid through the nozzle opening or orifice 214. A piezoelectric actuator, as an example of a drop ejecting element, may include a piezoelectric material provided on a movable membrane communicated with a fluid ejection chamber 202 such that, when activated, the piezoelectric material causes deflection of the membrane relative to the fluid ejection chamber 202, thereby generating a pressure pulse that ejects a drop of fluid through the nozzle opening or orifice 214.

As illustrated in FIG. 2A, the fluid ejection device 200 includes a fluid circulation channel 218 and a fluid circulating element 220 formed in, provided within, or communicated with the fluid circulation channel 218. The fluid circulation channel 218 includes a channel section 222 that is open to and in fluid communication at one end 224 (or first end 224) with the fluid feed slot 212. The channel section 222 is also open to and in fluid communication at an opposite end 226 to a first circulation loop 228 and a second circulation loop 230. The first circulation loop 228 is further open to and in fluid communication at a second end 232 to an end 202*a* of the fluid ejection chamber 202. The second circulation loop 230 is further open to and in fluid communication at a second end 234 to an end 204*a* of the fluid ejection chamber 204. As shown in FIG. 2A, each of the first circulation loop 228 and the second circulation loop 230 may be U-shaped channel. According to an example, the fluid circulation channel 218 has a substantially constant width throughout the channel section 222 and the first and second circulation loops 228, 230. That is, for instance, the width of the fluid circulation channel 218 may be within a range of deviation that is less than about 10% of an average width of the fluid circulation channel 218 across the channel section 222 and the first and second circulation loops 228, 230.

The fluid circulating element 220 may form or represent an actuator to pump or circulate (or recirculate) fluid through the fluid circulation channel 218. As such, fluid from the fluid feed slot 212 may circulate (or recirculate) through the channel section 222 of the fluid circulation channel 218 and through the first circulation loop 228, the second circulation loop 230, and the fluid ejection chambers 202, 204 based on flow induced by the fluid circulating element 220. As such, fluid in the fluid circulation channel 218 may circulate (or recirculate) between the fluid feed slot 212 and the fluid ejection chamber 202 through the channel section 222 and the first circulation loop 228. Fluid in the fluid circulation channel 218 may also circulate (or recirculate) between the fluid feed slot 212 and the fluid ejection chamber 204 through the channel section 222 and the second circulation loop 230. Circulating (or recirculating) fluid through the fluid ejection chambers 202, 204 may help to reduce ink blockage and/or clogging in the fluid ejection device 200.

As illustrated in FIG. 2A, the first circulation loop 228 and the second circulation loop 230 of the fluid circulation channel 218 communicate with the two fluid ejection chambers 202, 204, which are in fluid communication with two nozzle openings or orifices 214, 216. As such, the fluid ejection device 200 has a 2:1 nozzle-to-pump ratio, where the fluid circulating element 220 is referred to as a "pump" which induces fluid flow through the first circulation loop 228, the second circulation loop 230 and the fluid ejection chambers 202, 204. With a 2:1 ratio, circulation is provided for each of the fluid ejection chambers 202, 204 by a single fluid circulating element 220 in the fluid circulation channel 218. Other nozzle-to-pump ratios (e.g., 3:1, 4:1, etc.) are also possible, where one fluid circulating element 220 induces fluid flow through a fluid circulation channel communicated with multiple fluid ejection chambers and, therefore, multiple nozzle openings or orifices.

In the example illustrated in FIG. 2A, the drop ejecting elements 206, 208 and the fluid circulating element 220 are thermal resistors. Each of the thermal resistors may include, for example, a single resistor, a split resistor, a comb resistor, or multiple resistors. A variety of other devices, however, may also be used to implement the drop ejecting elements 206, 208 and the fluid circulating element 220 including, for example, a piezoelectric actuator, an electrostatic (MEMS) membrane, a mechanical/impact driven membrane, a voice coil, a magneto-strictive drive, and so on.

As also illustrated in FIG. 2A, the fluid ejection device 200 includes bubble dissipating structure 240 which may be formed within the fluid circulation channel 218. The bubble dissipating structure 240 includes, for example, a pillar, a column, a post or other structure (or structures) formed in or provided within fluid circulation channel 218. For instance, the bubble dissipating structure 240 may include a plurality of pillars arranged in an array within the fluid circulation channel 218. The bubble dissipating structure 240 may be formed of the same or similar material as the substrate 210 and may be formed in or provided within the fluid circulation channel 218 during formation of the fluid circulation channel 218.

In one example, the bubble dissipating structure 240 forms an "island" in the fluid circulation channel 218 which allows fluid to flow therearound and into the fluid ejection chambers 202, 204 while preventing particles, such as air bubbles or other particles (e.g., dust, fibers), from flowing into the fluid ejection chambers 202, 204 through the fluid circulation channel 218. Such particles, if allowed to enter the fluid ejection chambers 202, 204, may affect a performance of the fluid ejection device 200. In addition, the bubble dissipating structure 240 may also prevent particles from flowing into the channel section 222 and, therefore, to fluid circulating element 220 from the fluid ejection chambers 202, 204.

As shown in FIG. 2A, the fluid circulating element 220 may be formed in, provided within, or communicated with the channel portion 222, and the bubble dissipating structure 240 may be formed at a junction between the channel portion 222 and the first and second circulation loops 228, 230. In an alternate example, the bubble dissipating structure 240 may be positioned at other locations within the fluid circulation channel 218. For instance, the bubble dissipating structure 240 may be formed or provided within the channel section 222 closer to the fluid circulating element 220 than as shown in FIG. 2A.

In another example, as shown in FIG. 2B, the fluid ejection device 200 may include multiple bubble dissipating structures 240 formed in or provided within the fluid circulation channel 218. Particularly, a first bubble dissipating structure 240 may be formed in or provided within the first circulation loop 228 and a second bubble dissipating structure 240 may be formed in or provided within the second circulation loop 230. In other examples, the first and second bubble dissipating structures 240 may be respectively formed in or provided within the first circulation loop 228 and the second circulation loop 230 closer to the fluid ejection chambers 202, 204. In still further examples, the first and second bubble dissipating structures 240 may be respectively formed in or provided within the first circulation loop 228 and the second circulation loop 230 closer to the junction of the first and second circulation loops 228, 230.

Figure 2D:
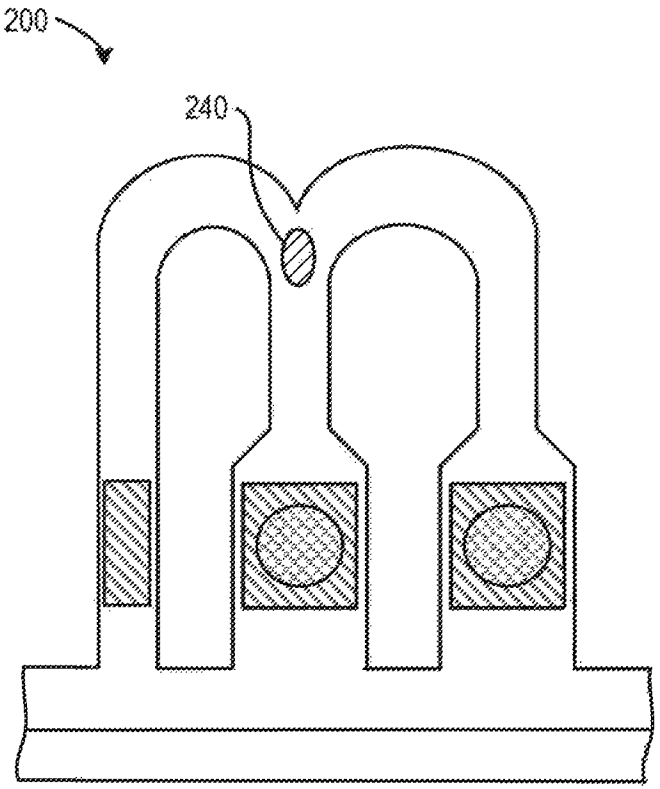
Figure 2C:
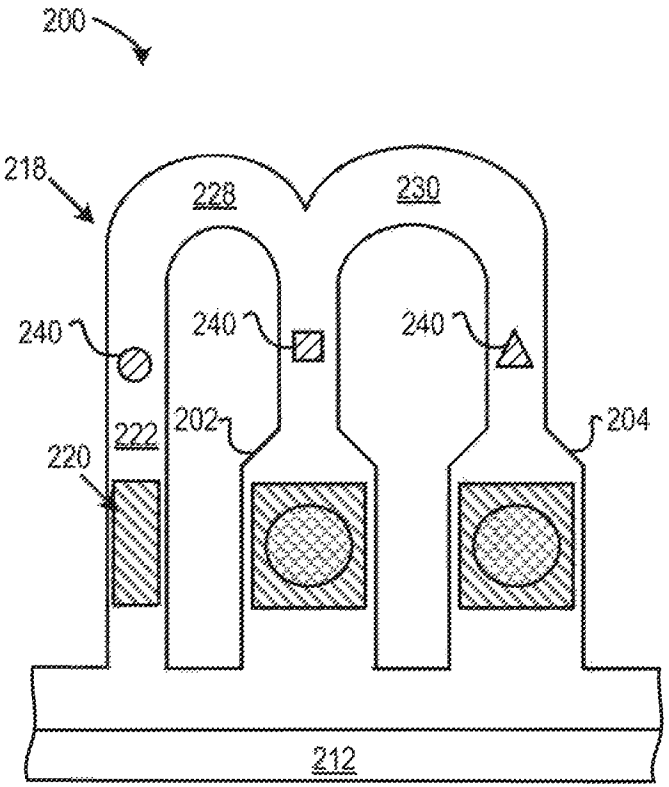

In further examples, the fluid ejection device 200 may have other configurations, in which a bubble dissipating structure 240 is (or multiple bubble dissipating structures 240 are) formed in or provided within the fluid circulation channel 218. For instance, as shown in FIGS. 2C and 2D, the fluid circulation channel 218 may have a different configuration than as shown in FIGS. 2A and 2B. Particularly, instead of being positioned between the fluid ejection chambers 202, 204, the channel section 222 may be positioned on one side of the fluid ejection chambers 202, 204. In addition, the first circulation loop 228 may be in fluid communication with the channel section 222 and the first fluid ejection chamber 202 and the second circulation loop 230 may be in fluid communication with the first circulation loop 228 and the second fluid ejection chamber 204. In the example shown in FIG. 2C, a bubble dissipating structure 240 is formed in or positioned within each of the channel section 222, the first circulation loop 228, and the second circulation loop 230. In the example shown in FIG. 2D, a bubble dissipating structure 240 is formed in or positioned within a junction of the first circulation loop 228 and the second circulation loop 230. In FIGS. 2C and 2D, some of the bubble dissipating structures 240 are depicted as having shapes other than circles, for purposes of illustration. In addition, it should be understood that the bubble dissipating structure 240 may be formed in or positioned at other locations of the fluid circulation channel 218 shown in FIGS. 2C and 2D without departing from a scope of the fluid dejection device disclosed herein.

Figure 2E:
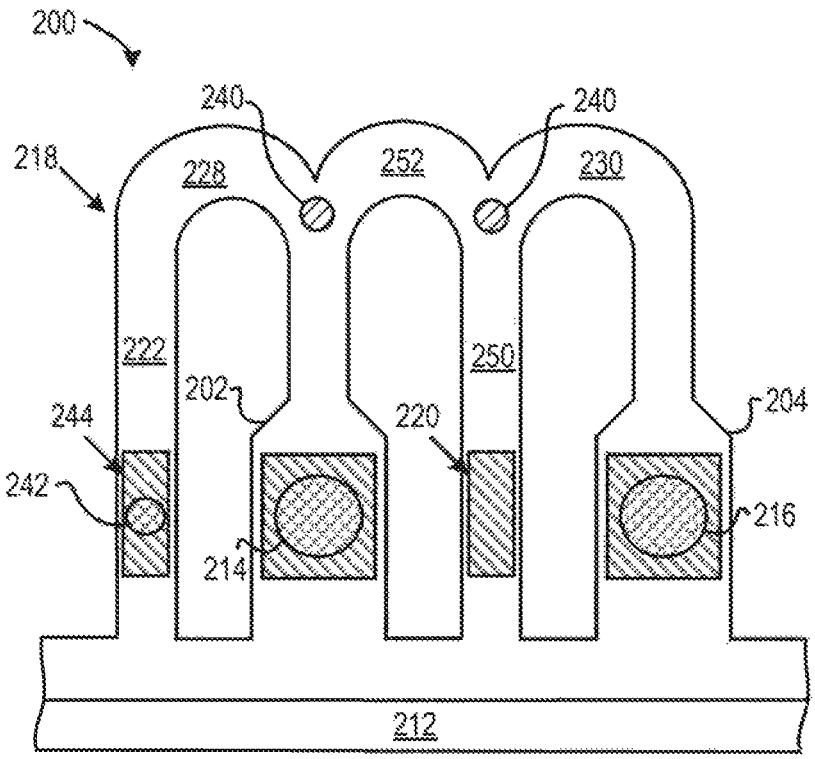

Turning now to FIG. 2E, there is shown a schematic plan view of a portion of a fluid ejection device 200, according to another example. In addition to the features shown in FIGS. 2A-2D, in FIG. 2E, the fluid ejection device 200 is depicted as including an additional channel section 250 positioned between the first fluid ejection chamber 202 and the second fluid ejection chamber 204. Similarly to the channel section 222, the additional channel section 250 may be in fluid communication with the fluid feed slot 212 and may also include a fluid circulating element 220. However, the channel section 222 may include a nozzle opening or orifice 242 through which fluid contained in part of the channel section 222 may be ejected when a drop ejecting element 244 is energized. The nozzle opening or orifice 242 may have a smaller diameter as compared with the nozzle openings 214, 216 in the fluid ejection chambers 202, 204. Fluid ejected through the nozzle opening 242 may thus have a relatively lower drop weight as compared with fluid ejected through the other nozzle openings 214, 216.

As also shown in FIG. 2E, the second fluid circulation loop 230 may be in fluid communication with the additional channel section 250. In addition, the fluid circulation channel 218 may include a third fluid circulation loop 252 that is also in fluid communication with the additional channel section 250. The third fluid circulation loop 252 may also be in fluid communication with the first circulation loop 228. As further shown in FIG. 2E, a plurality of bubble dissipating structures 240 may be positioned in the fluid circulation channel 218. For instance, as shown, a first bubble dissipating structure 240 may be formed in or positioned within a junction between the first circulation loop 228 and the third circulation loop 252 and a second bubble dissipating structure 240 may be formed in or positioned within a junction between the second circulation loop 230 and the third circulation loop 252. It should be understood that the bubble dissipating structure 240 or structures may be formed in or positioned at other locations of the fluid circulation channel 218 depicted in FIG. 2E without departing from a scope of the fluid dejection device disclosed herein.

With regard to FIGS. 2B-2E, some of the elements depicted therein are not provided with reference numerals for purposes of simplicity. It should thus be understood that the reference numerals provided in FIG. 2A are intended to also pertain to the elements depicted in FIGS. 2B-2E.

Figure 3:
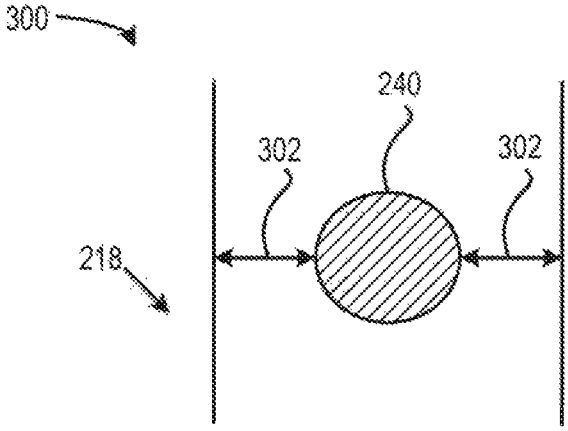
FIG. 3 shows an enlarged view of a portion of a fluid circulation channel and a bubble dissipating structure, according to an example of the present disclosure.

Turning now to FIG. 3, there is shown an enlarged view of a portion of the fluid circulation channel 218 and a bubble dissipating structure 240, according to an example. The bubble dissipating structure 240 may be sized to minimize or restriction of fluid flow through the fluid circulation channel 218 while dissipating bubbles that may flow through the fluid circulation channel 218. For instance, the distances 302 between any of the walls of the fluid circulation channel 218 and a perimeter of the bubble dissipating structure 240 may be set to be within a predefined width range. By way of example, the width of the bubble dissipating structure 240 may be such that the distances between the bubble dissipating structure 240 and the walls of the fluid circulation channel 218 are sufficiently small to cause bubbles passing therethrough to dissipate while still allowing flow of fluid between the bubble dissipating structure 240 and the walls.

Although the bubble dissipating structure 240 has been depicted as having a circular cross section, it should be understood that the bubble dissipating structure 240 may have other cross-sectional shapes. For instance, the bubble dissipating structure 240 may have a square shape, an oval shape, a triangular shape, a rectangular shape, etc. Additionally, in instances in which a fluid circulation channel 218 includes a plurality of bubble dissipating structures 240, some or all of the bubble dissipating structures 240 may have the same size and shape with respect to each other or some or all of the bubble dissipating structures 240 may have different sizes and/or shapes with respect to each other.

Figure 4:
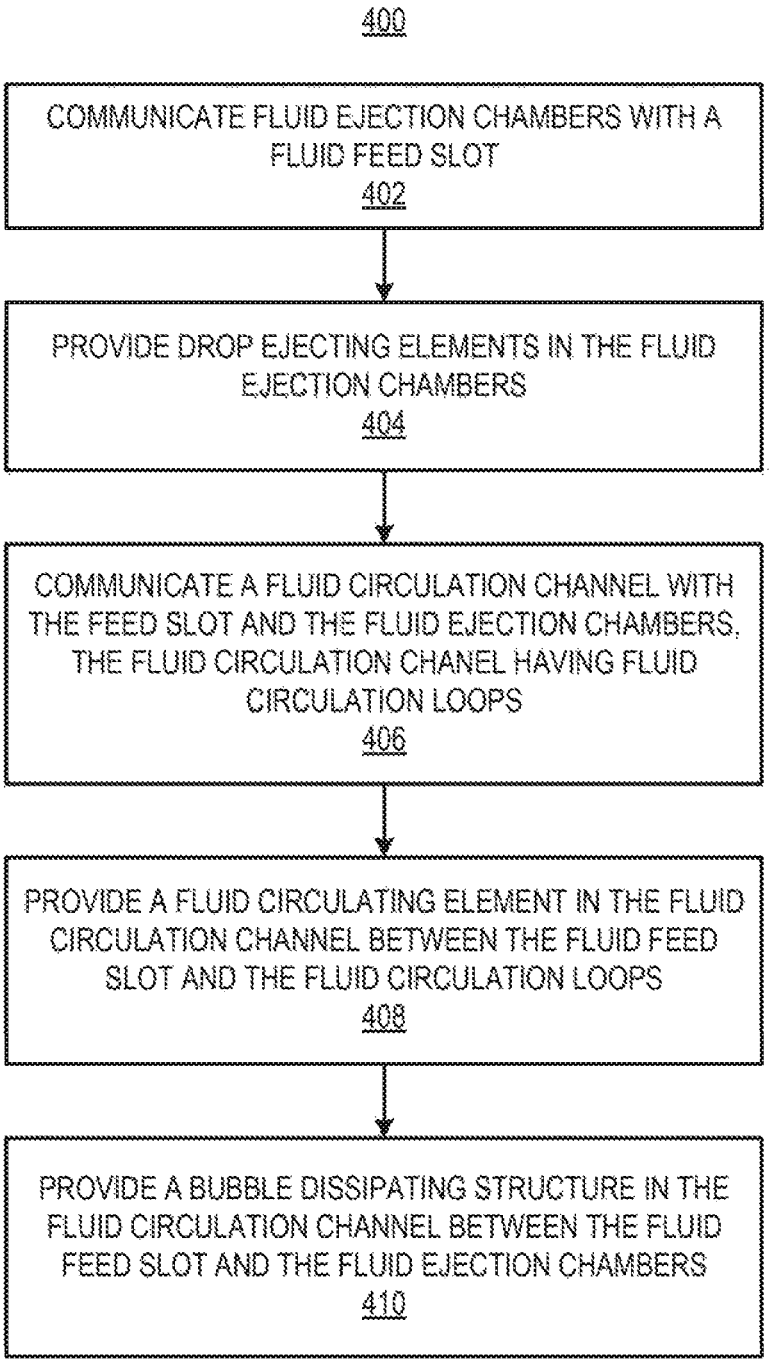
FIG. 4 shows a flew diagram of a method of forming fluid ejection device, according to an example of the present disclosure.

With reference n w to FIG. 4, there is shown a flow diagram of a method 400 of forming a fluid ejection device, such as the fluid ejection device 200 depicted in FIGS. 2A-2E, according to an example.

At block 402, a plurality of fluid ejection chambers, such as fluid ejection chambers 202, 204, may be communicated with a fluid feed slot, such as fluid feed slot 212. Particularly, for instance, the fluid ejection chambers 202, 204 may be formed or otherwise made to be in fluid communication with the fluid feed slot 212.

At block 404, a plurality of drop ejecting elements, such as drop ejecting elements 206, 208, may be provided within or formed in each of the fluid ejection chambers, such as the fluid ejection chambers 202, 204.

At block 406, a fluid circulation channel, such as the fluid circulation channel 218, may be communicated with the fluid feed slot and the fluid ejection chambers, such as the fluid feed slot 212 and the fluid ejection chambers 202, 204. In addition, at block 406, the fluid circulation channel 218 may be formed with a channel section and a plurality of fluid circulation loops such as the channel section 222 and the fluid circulation loops 228, 230.

At block 408, a fluid circulating element, such as the fluid circulating element 220, may be provided in the fluid circulation channel 218 between the fluid feed slot 212 and the plurality of fluid circulation loops.

At block 410, a bubble dissipating structure 240 may be provided within or formed in the fluid circulation channel 218 between the fluid feed slot 218 and the fluid ejection chambers 202, 204. The bubble dissipating structure 240 may be formed in the fluid circulation channel 218 during fabrication of the other components of the fluid ejection device 200. In addition, the bubble dissipating structure 240 may be formed of the same or similar material as the substrate 210. Thus, for instance, the bubble dissipating structure 240 may be formed in the fluid circulation channel 218 during formation of the fluid circulation channel 218.

Although illustrated and described as separate and/or sequential steps, the method of the fluid ejection device may include a different order or sequence of steps, and may combine one or more steps or perform one or more steps concurrently, partially or wholly.

With the fluid ejection device 200 including circulation (or recirculation) of fluid as described herein, ink blockage and/or clogging may be reduced. As such, decap time (i.e., an amount of time inkjet nozzles may remain uncapped and exposed to ambient conditions) and, therefore, nozzle health may be improved. In addition, pigment-ink vehicle separation and viscous ink plug formation within the fluid ejection device 200 may be reduced or eliminated. Furthermore, ink efficiency may be improved by lowering ink consumption during servicing (e.g., minimizing spitting of ink to keep nozzles healthy).

In addition, including the bubble dissipating structure 240 in the fluid circulation channel 218 as described herein, may help to prevent air bubbles and/or other particles from entering the fluid ejection chambers 202, 204 from the fluid circulation channel 218 during circulation (or recirculation) of fluid through the fluid circulation channel 218 and the fluid ejection chambers 202, 204. As such, disruption of the ejection of drops from the fluid ejection chambers 202, 204 may be reduced or eliminated. In addition, the bubble dissipating structure 240 may also help to prevent air bubbles and/or other particles from entering the fluid circulation channel 218 from the fluid ejection chambers 202, 204.

Although described specifically throughout the entirety of the instant disclosure representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A fluid ejection device, comprising:

a fluid feed slot;

a plurality of fluid ejection chambers in fluid communication with the fluid feed slot;

a plurality of drop ejecting elements, wherein a drop ejecting element of the plurality of drop ejecting elements is positioned within each of the plurality of fluid ejection chambers;

a fluid circulation channel in fluid communication at a first end of the fluid circulation channel with the fluid feed slot and in fluid communication at multiple second ends of the fluid circulation channel with the plurality of fluid ejection chambers;

a fluid circulating element within the fluid circulation channel; and a bubble dissipating structure positioned within the fluid circulation channel outside of the plurality of fluid ejection chambers.

2. The fluid ejection device of claim 1, wherein the fluid circulation channel comprises a substantially constant width between the first end and the multiple second ends and wherein the bubble dissipating structure is positioned between the first end and the multiple second ends.

3. The fluid ejection device of claim 1, wherein the fluid circulation channel comprises a first section positioned adjacent to the first end and multiple second sections respectively positioned adjacent to the multiple second ends, wherein the first section is in fluid communication with each of the multiple second ends via respective fluid circulation loops.

4. The fluid ejection device of claim 3, wherein the bubble dissipating structure is positioned within the first section.

5. The fluid ejection device of claim 3, wherein the bubble dissipating structure is positioned within each of the multiple second ends.

6. The fluid ejection device of claim 3, wherein the bubble dissipating structure is positioned at one of a junction between the fluid circulation loops and the first section and within at least one of the fluid circulation loops.

7. The fluid ejection device of claim 3, wherein the fluid circulation loops are formed of U-shaped channels.

8. The fluid ejection device of claim 3, wherein the fluid circulation loops comprise a first fluid circulation loop extending to a first side of the first section and a second fluid circulation loop extending to a second side of the first section.

9. The fluid ejection device of claim 1, wherein the bubble dissipating structure comprises a structure having a cross-section selected from the group consisting of circular, oval, and polygonal.

10. The fluid ejection device of claim 1, wherein the fluid circulating element is sandwiched between the fluid feed slot and the bubble dissipating structure.

11. The fluid ejection device of claim 1, wherein the bubble dissipating structure is positioned within the fluid circulation channel between the fluid circulating element and a particular one of the fluid ejection chambers.

12. The fluid ejection device of claim 1, wherein the fluid circulation channel comprises three U-shaped fluid circulation loops.

13. A fluid ejection device, comprising:

a fluid feed slot;

a plurality of fluid ejection chambers in communication with the fluid feed slot;

a plurality of drop ejecting elements, wherein a drop ejecting element of the plurality of drop ejecting elements is positioned within each of the plurality of fluid ejection chambers;

a fluid circulation channel including a plurality of fluid circulation loops in fluid communication with the fluid feed slot and the plurality of fluid ejection chambers;

a fluid circulating element within the fluid circulation channel between the fluid feed slot and the plurality of fluid circulation loops; and a plurality of bubble dissipating structures positioned within the fluid circulation channel between the fluid feed slot and the plurality of fluid ejection chambers.

14. The fluid ejection device of claim 13, wherein the fluid circulation channel comprises a substantially constant width between the fluid feed slot and the plurality of fluid ejection chambers.

15. The fluid ejection device of claim 13, wherein the fluid circulation channel comprises a channel section positioned adjacent to the fluid feed slot and multiple second sections respectively positioned adjacent to the plurality of fluid ejection chambers, wherein the channel section is in fluid communication with each of the multiple second ends via respective ones of the plurality of fluid circulation loops.

16. The fluid ejection device of claim 15, wherein the plurality of bubble dissipating structures are positioned within one of a junction between the channel section and the plurality of fluid circulation loops and one of the plurality of fluid circulation loops.

17. The fluid ejection device of claim 13, wherein the bubble dissipating structures are positioned within the fluid circulation channel between the fluid circulating element and a respective one of the fluid ejection chambers.

18. A method of forming a fluid ejection device, comprising:

communicating a plurality of fluid ejection chambers with a fluid feed slot;

providing a respective drop ejecting element in each of the plurality of fluid ejection chambers;

communicating a fluid circulation channel with the fluid feed slot and each of the plurality of fluid ejection chambers, said fluid circulation channel having a plurality of fluid circulation loops;

providing a fluid circulating element in the fluid circulation channel between the fluid feed slot and the plurality of fluid circulation loops; and providing a bubble dissipating structure in the fluid circulation channel between the fluid feed slot and the plurality of fluid ejection chambers.

19. The method of claim 18, wherein communicating the fluid circulation channel further comprises providing the fluid circulation channel to have a substantially constant width between the fluid feed slot and the plurality of fluid ejection chambers.

20. The method of claim 19, wherein providing the bubble dissipating structure in the fluid circulation channel further comprises providing a plurality of bubble dissipating structures in a junction between the plurality of fluid circulation loops and the plurality of fluid ejection chambers.

* * * * *